US008201665B2

(12) United States Patent
Gieras et al.

(10) Patent No.: US 8,201,665 B2
(45) Date of Patent: Jun. 19, 2012

(54) MAGNETIC DOOR COUPLING DEVICE FOR AN ELEVATOR SYSTEM

(75) Inventors: Jacek F. Gieras, Glastonbury, CT (US); Pei-Yuan Peng, Ellington, CT (US); Bryan Siewert, Westbrook, CT (US)

(73) Assignee: Otis Elevator Company, Farmington, CT (US)

( * ) Notice: Subject to any disclaimer, the term of this patent is extended or adjusted under 35 U.S.C. 154(b) by 468 days.

(21) Appl. No.: 12/524,258

(22) PCT Filed: Mar. 23, 2007

(86) PCT No.: PCT/US2007/064763

§ 371 (c)(1), (2), (4) Date: Jul. 23, 2009

(87) PCT Pub. No.: WO2008/118166

PCT Pub. Date: Oct. 2, 2008

(65) Prior Publication Data

US 2010/0247397 A1 Sep. 30, 2010

(51) Int. Cl.
*B66B 13/02* (2006.01)

(52) U.S. Cl. ..... 187/315; 49/120

(58) Field of Classification Search ..... 187/316, 187/317, 319, 324, 326, 315; 49/103, 106, 49/120, 122; 310/12.15, 12.27
See application file for complete search history.

(56) References Cited

U.S. PATENT DOCUMENTS

| | | | | |
|---|---|---|---|---|
| 2,925,538 | A | 2/1960 | Rasmusen | |
| 4,558,271 | A * | 12/1985 | Poole | 323/306 |
| 5,487,449 | A * | 1/1996 | Barrett et al. | 187/330 |
| 5,736,693 | A * | 4/1998 | Piech et al. | 187/316 |
| 6,675,938 | B2 * | 1/2004 | Yamamoto et al. | 187/316 |
| 7,218,196 | B2 * | 5/2007 | Nakao et al. | 336/83 |
| 2008/0257653 | A1 * | 10/2008 | Gieras et al. | 187/330 |
| 2008/0271957 | A1 * | 11/2008 | Siewert et al. | 187/319 |
| 2010/0038187 | A1 * | 2/2010 | Gieras et al. | 187/330 |
| 2010/0282546 | A1 * | 11/2010 | Han et al. | 187/319 |

FOREIGN PATENT DOCUMENTS

| | | | |
|---|---|---|---|
| JP | 02168030 | A * | 6/1990 |
| JP | 2003022908 | | 1/2003 |
| SU | 773852 | B * | 10/1980 |
| WO | 9428559 | | 12/1994 |
| WO | 2005024860 | A1 | 3/2005 |
| WO | 2007044008 | A1 | 4/2007 |

OTHER PUBLICATIONS

International Search Report and Written Opinion of the International Searching Authority for International application No. PCT/US2007/064763 mailed Dec. 12, 2007.

International Preliminary Report on Patentability for International application No. PCT/US2007/064763 mailed 09.06,2998.

* cited by examiner

*Primary Examiner* — Anthony Salata
(74) *Attorney, Agent, or Firm* — Carlson, Gaskey & Olds PC

(57) ABSTRACT

An exemplary magnetic coupling device (30) useful for coupling elevator doors includes a core (40) having an exterior surface. An active portion (48) of the surface is configured to direct a magnetic flux associated with the core in a desired direction for facilitating elevator door coupling. An interruption (80) in the exterior surface near the active portion (48) is configured to establish a relatively high magnetic saturation in the core in a vicinity of the interruption (80).

20 Claims, 3 Drawing Sheets

MAGNETIC DOOR COUPLING DEVICE FOR AN ELEVATOR SYSTEM

BACKGROUND

Elevators typically include a car that moves vertically through a hoistway between different levels of a building. At each level or landing, a set of hoistway doors are arranged to close off the hoistway when the elevator car is not at that landing. The hoistway doors open with doors on the car to allow access to or from the elevator car when it is at the landing. It is necessary to have the hoistway doors coupled appropriately with the car doors to open or close them.

Conventional arrangements include a door interlock that typically integrates several functions into a single device. The interlocks lock the hoistway doors, sense that the hoistway doors are locked and couple the hoistway doors to the car doors for moving them together. While such integration of multiple functions provides lower material costs, there arc significant design challenges presented by conventional arrangements. For example, the locking and sensing functions must be precise to satisfy codes. The coupling function, on the other hand, requires a significant amount of tolerance to accommodate variations in the position of the car doors relative to the hoistway doors. While these functions are typically integrated into a single device, their design implications are usually competing with each other.

Conventional door couplers include a vane on the car door and a pair of rollers on a hoistway door. The vane must be received between the rollers so that the hoistway door moves with the car door in two opposing directions (i.e., opening and closing). Common problems associated with such conventional arrangements is that the alignment between the car door vane and the hoistway door rollers must be precisely controlled. This introduces labor and expense during the installation process. Further, any future misalignment results in maintenance requests or call backs.

It is believed that elevator door system components account for approximately 50% of elevator maintenance requests and 30% of callbacks. Almost half of the callbacks due to a door system malfunction are related to one of the interlock functions.

Some proposed door couplers utilize magnetic forces for coupling the doors. Examples of this type are shown in U.S. Pat. Nos. 5,487,449; 5,174,417; and 6,070,700.

SUMMARY

An exemplary magnetic coupling device includes a core having an exterior surface. An active portion of the core is configured to direct a magnetic flux associated with the core in a desired direction. An interruption in the exterior surface near the active portion is configured to establish a relatively high magnetic saturation in the core in a vicinity of the interruption.

The various features and advantages of this invention will become apparent to those skilled in the art from the following detailed description. The drawings that accompany the detailed description can be briefly described as follows.

DETAILED DESCRIPTION

Figure 1A:
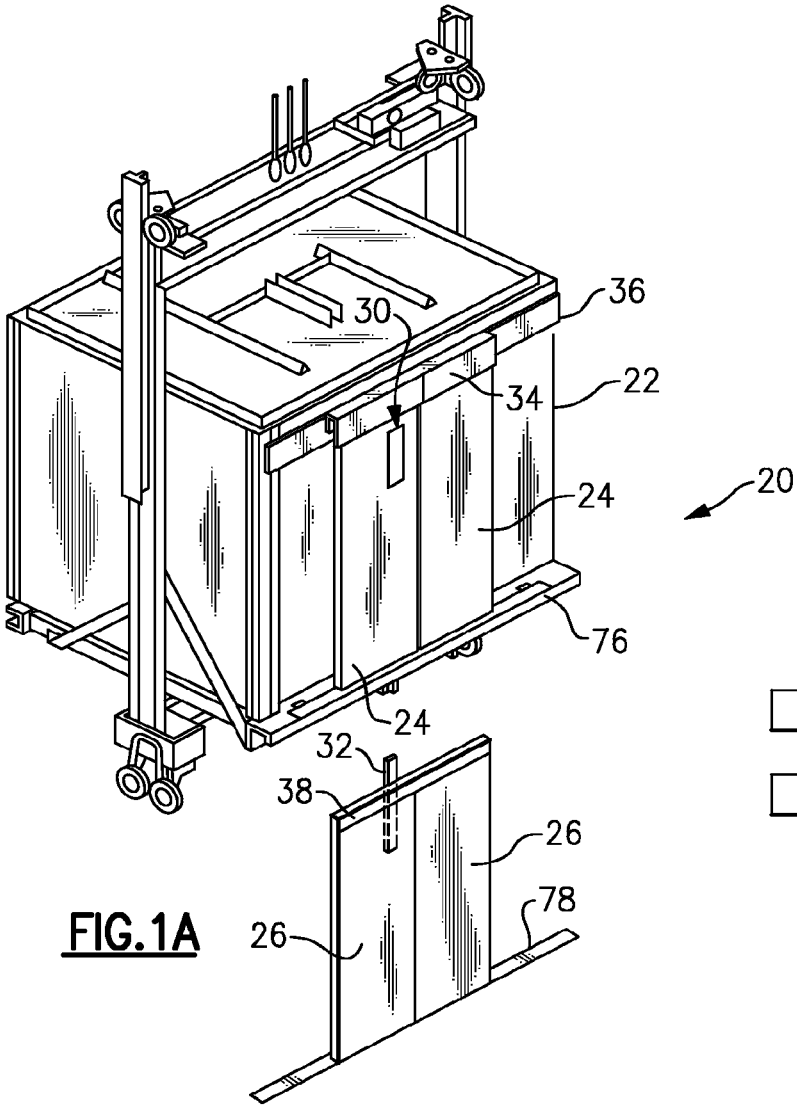
FIG. 1A schematically illustrates selected portions of an elevator system incorporating a door assembly designed according to an embodiment of this invention.

FIG. 1A schematically shows an elevator door assembly 20 that includes a unique door coupler. An elevator car 22 has car doors 24 that are supported for movement with the car 22 through a hoistway, for example. The car doors 24 become aligned with hoistway doors 26 at a landing, for example, when the car 22 reaches an appropriate vertical position.

The illustrated example includes a door coupler to facilitate moving the car doors 24 and the hoistway doors 26 in unison when the car 22 is appropriately positioned at a landing. In this example, the door coupler includes an electromagnet 30 associated with at least one of the car doors 24. At least one of the hoistway doors 26 has an associated ferromagnetic vane 32 that cooperates with the electromagnet 30 to keep the doors 26 moving together with the doors 24 as desired.

Figure 1B:
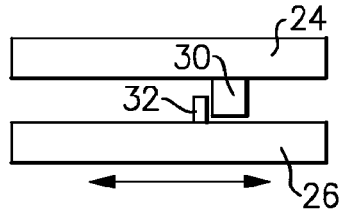
FIG. 1B schematically shows interaction between door coupler components for door movement.

As shown in FIG. 1B, the electromagnet 30 magnetically attracts the vane 32 to facilitate moving the doors 26 and 24 in unison between open and closed positions.

Given the tight dimensional constraints on elevator door coupler arrangements, the illustrated example includes a unique electromagnet design that concentrates the attractive, magnetic force for coupling the electromagnet 30 with the vane 38 so that the elevator doors 24 and 26 are appropriately coupled together.

Figure 2:
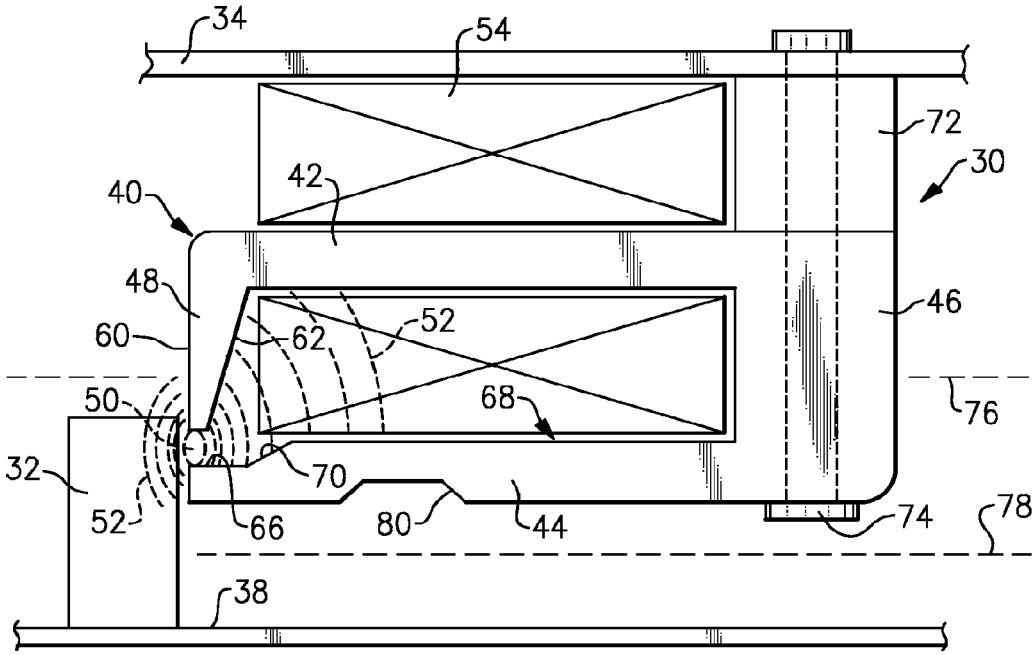
FIG. 2 schematically illustrates an example electromagnet configuration of an embodiment of this invention.
Figure 3:
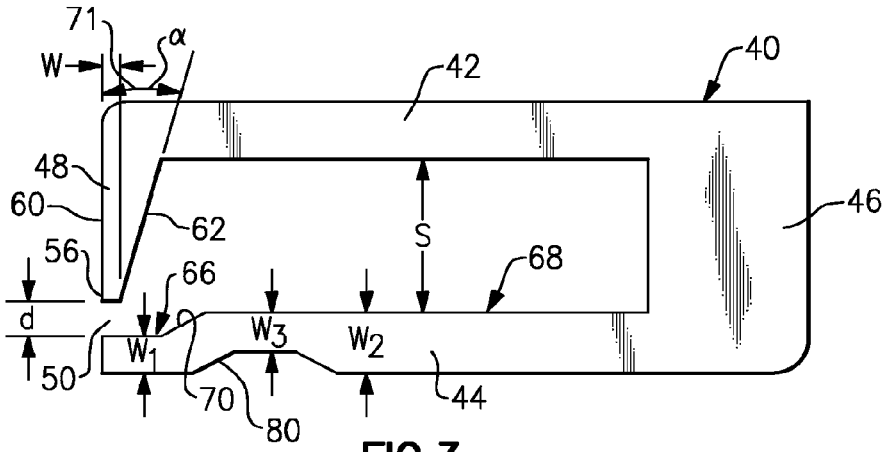
FIG. 3 shows selected features of the embodiment of FIG. 2.

Referring to FIGS. 2 and 3, an example embodiment of an electromagnet 30 is shown in a partially cross-sectional, elevational view as seen from the top, for example, in FIG. 1. The illustrated electromagnet 30 includes a core 40 made from an appropriate ferromagnetic material. Those skilled in the art who have the benefit of this description will be able to select from appropriate metals, laminations or sintered powders for making the core 40 according to the needs of their particular situation. Example materials used for making the core include carbon steel, silicon steel, sintered magnetic powder, laminated magnetic materials or other ferromagnetic materials.

The example core 40 includes a first side 42 and a second side 44 that are aligned at least partially generally parallel to each other. A third side 46 and a fourth side 48 are aligned at least partially generally parallel to each other. The third side 46 and fourth side 48 are also generally perpendicular to the first side 42 and the second side 44. In this example, each side 42, 44, 46 and 48 corresponds to a pole of the electromagnet.

The exterior surface of the first side 42 and the third side 46 are uninterrupted (e.g., each comprises a solid, continuous exterior surface across the side) as can be appreciated from the drawing. In particular, the exterior surface of each of the first side 42 and the third side 46 are uninterrupted in this example. The fourth side 48 in this example includes a gap 50. In this example, the gap 50 extends completely through and along the entire height or longitudinal length (shown as L in FIG. 5) of the fourth side 48.

Although the illustrated example includes generally straight sides and a generally rectangular configuration, other configurations are possible that still include first and second sides arranged at least partially generally parallel to each other, third and fourth sides arranged at least partially generally parallel to each other and a gap in at least one of the sides. In other words, a core with a partially circular or irregularly shaped configuration may still have a plurality of sides and a gap that achieves the benefits of the illustrated example. One example includes two sides that are generally arcuate and aligned as mirror images of each other such that tangents along corresponding portions of the sides are generally parallel. Some example uses of such an electromagnet include a configuration different than the illustrated generally rectangular core configuration.

Providing a fourth side 48 on the core instead of providing a conventional U-shape for the core and leaving a gap 50 that is smaller than a spacing between the first side 42 and the second side 44 concentrates the magnetic flux schematically shown at 52 and the associated magnetic attractive force of the electromagnet 30 near the gap 50. Only a portion of the entire magnetic flux distribution of the electromagnet 30 is schematically shown at 52 in FIG. 2.

By strategically placing the gap 50 relative to the vane 32, the disclosed example allows for concentrating the attractive magnetic force used to couple the electromagnet 30 to the vane 32, which facilitates coupling the elevator car and hoistway doors for movement together.

The illustrated example includes dimensional relationships between portions of the electromagnet 30 that have been designed to optimize the attractive force realizable within constraints placed on the electromagnet by the nature of the elevator door assembly and applicable codes. As can be appreciated from FIG. 3, interior surfaces on the first side 42 and the second side 44 are spaced apart a distance s, which provides a spacing for receiving at least a portion of an electrically conductive coil 54. Energizing the coil 54 in a known manner results in generating the magnetic field used for coupling the electromagnet 30 to the vane 32, for example. In this example, the gap 50 has a dimension d. The size of the dimension d is less than the spacing s. The fourth side 48 in this example has a nominal width w on a portion 56 adjacent the gap 50. In addition, the width of the fourth side 48 is variable and increases in size as the side extends away from the gap 50. The second side 44, which is adjacent to the gap 50 in this example, has a nominal width $w_1$ along a portion 66 adjacent to the gap 50. The second side 44 also has a larger width $w_2$ along a portion 68 that is further from the gap 50 compared to the portion 66.

The configuration of the fourth side 48 in this example optimizes the amount of attractive force realizable with the given gap configuration. In this example, the fourth side 48 has an exterior surface 60 that faces generally outward or toward the vane 32. An oppositely facing surface 62 faces toward an interior of the core 40. In this example, the surface 62 is oriented transverse to the first surface 60. An oblique angle $\alpha$ of the orientation of the surface 62 relative to the surface 60 in this example depends on other dimensions of the core 40.

In one example, the angle $\alpha$ (shown at 71 in FIG. 3) is approximately equal to the arctangent of the width of the second side 44 divided by the sum of the inside space s and the dimension d (e.g., $\alpha \approx \arctan(w_1/(s+d))$). In one example, the nominal width $w_1$ of the second side 44 is used for determining the angle $\alpha$. In another example, the width $w_2$ is used (e.g., a $\arctan(w_2/(s+d))$).

In this example, the nominal width w of the fourth side 48 at the portion 56 is selected to have a dimensional relationship to the dimension d of the gap 50. In one example, the nominal width w is selected to be less than or equal to approximately d/2. As can be appreciated from the illustration, the width of the fourth side 48 increases in a generally linear fashion in a direction moving away from the gap 50.

The nominal width $w_1$ of the second side 44 in this example is in a range below $9/10\ w_2$.

The illustrated example includes a ramped surface 70 along a portion of the first side 44 facing the interior of the core 40. In this example, the ramped surface 70 is oriented at an oblique angle relative to the gap 50. The oblique angle $\alpha$ in this example is different than the oblique angle at which the ramped surface 70 is oriented relative to the gap 50. Having the angled surfaces in the illustrated example increases the attractive force realizable at the gap 50 compared to an arrangement where the interior surfaces of the core 50 are perpendicular to each other.

As best appreciated in FIG. 2, the illustrated example is thermally coupled with the door hanger 34 such that the door hanger 34 acts as a heat sink for the electromagnet 30. In this example, the third side 46 has an increased thickness compared to the other sides of the core 40. In this example, an aluminum block 72 is used for mounting the electromagnet 30 to the door hanger 34. The block 72 and the core 40 are held in place by one or more fasteners 74. The aluminum block 72 allows a spacing for a portion of the coil 54 to be received between the core 40 and the door hanger 34. An appropriate insulation or coating is provided on the coil 54 to electrically isolate the coil 54 from the door hanger 54.

The coupling through the aluminum block 72 provides for thermal conduction of heat from the electromagnet 30 through the door hanger 34. This provides a significant advantage in that distributing the heat from the electromagnet 30 allows for the example arrangement to fit within temperature limitations placed on such components by elevator codes. One example code requires that the temperature not exceed 80° C. The example arrangement allows for meeting this requirement without introducing bulky components that would not fit within the space constraints dictated by other code requirements. The illustration in FIG. 2 shows how one example arrangement fits within the space constraints between an elevator door sill 76 and a hoistway door sill 78. The same example complies with heat limitation requirements and provides sufficient magnetic coupling for reliably moving the doors 24 and 26 in unison.

The side 48 of the electromagnet 30 is considered an active side because it includes the concentration of the magnetic flux 52 at the gap 50. The active side or active portion or the core 40 is that which generates the greatest magnetic attractive force for coupling the electromagnet 30 with the vane 32.

The magnetic coupling of the illustrated examples may introduce a likelihood that ferrous debris may collect on the electromagnet 30. It is desirable to avoid having any ferrous debris gather around the gap 50 where it may interfere with an appropriate magnetic coupling between the electromagnet 30 and the vane 32. The illustrated example includes an interruption 80 in the exterior surface of the second side 44 of the core 40. The interruption 80 is configured to establish a relatively high magnetic flux concentration in the vicinity of the interruption 80 such that ferrous debris will be attracted toward the interruption 80. This facilitates avoiding ferrous debris buildup at the active portion (e.g., the gap 50) of the core 40.

The interruption 80 establishes a reduced cross-section of a corresponding portion of the core 40 in the vicinity of the interruption 80. As shown in FIG. 3, the second side 44 has a material thickness $W_3$ adjacent the interruption 80. The dimension of $W_3$ is less than the dimension $W_2$ along the portion 68 of the second side 44. This reduced cross-section $W_3$ introduces a higher magnetic flux concentration near the interruption 80 compared to other portions of the core 40. The portion of the core 40 in the vicinity of the interruption 80, therefore, becomes magnetically saturated at a higher rate than other portions of the core 40. At the same time, the concentration of the coupling force near or at the gap 50 is not diminished by the interruption 80.

In the illustrated example, the dimension of $W_3$ is approximately equal to a difference between $W_2$ and a depth of the interruption 80. In one example, $W_3$ is approximately equal to $W_1$. In another example, $W_3$ is one of greater than or less than $W_1$. Given this description, those skilled in the art will be able to select appropriate dimensions to meet the needs of their particular situation.

The interruption 80 is positioned relatively close to the gap 50. In one example, a distance between the active portion of the core 40 (e.g., the gap 50) and the interruption 80 is greater than a dimension of the gap 50. In one example, the gap 50 is approximately 7 mm wide. The interruption 80 is positioned on the second side 44 a distance that is between approximately twice and approximately five times the size of the gap 50 (e.g., between about 14 mm and 35 mm away from a 7 mm gap).

The reduced size of the core 40 in the vicinity of the interruption 80 and the relatively higher magnetic saturation tends to attract ferrous debris toward the interruption 80. If a ferromagnetic body is in the vicinity of the interruption 80, the magnetic field of the electromagnet 30 tends to minimize the reluctance for the magnetic flux. Accordingly, at least some of the magnetic flux will penetrate through the ferromagnetic body or ferrous debris because the reluctance of ferrous debris is smaller than that of the highly saturated, relatively narrow bridge of the core material adjacent the interruption 80 (e.g., the portion having the dimension $W_3$). Accordingly, any ferrous particles will tend to gather around the interruption 80.

Figure 4:
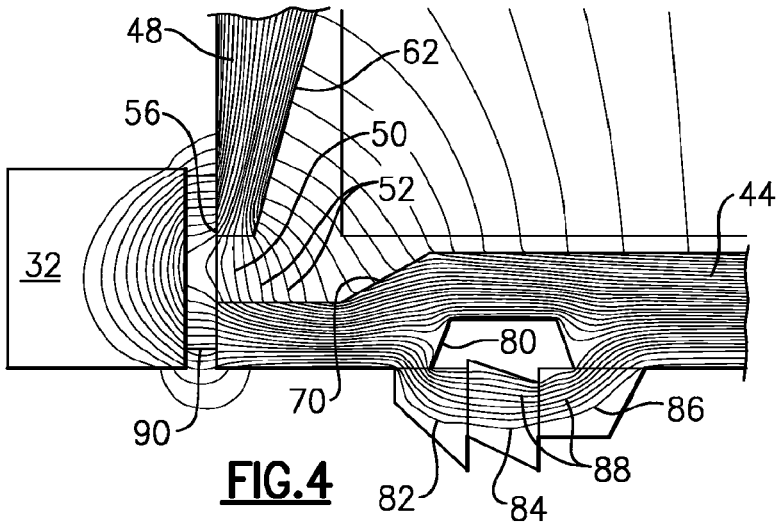
FIG. 4 shows another feature of the example embodiment.

This is schematically shown in FIG. 4 where ferrous debris particles 82, 84 and 86 are gathered around the interruption 80 and permit a portion of the magnetic flux schematically shown at 88 to pass through those particles.

The amount of magnetic flux that can pass through ferromagnetic debris gathered around the interruption 80 depends on the cross-section of that debris. A larger cross-section associated with larger debris or a larger collection of debris results in less magnetic flux in the otherwise highly saturated portion of the core in the vicinity of the interruption 80. The tendency to minimize the reluctance of the magnetic flux in the core 40 near the interruption 80 provides a coercive accumulation of ferrous debris as close as possible to the interruption 80.

As can be appreciated from FIG. 4, a non-magnetic material layer 90 is provided at the interface between the active side 48 of the core 40 and the vane 32. In one example, the non-magnetic material layer 90 is provided on the vane 32. In another example, the non-magnetic material layer 90 is provided on the core 40. One advantage to including such a layer is that it facilitates maintaining a desired spacing between the core material and the vane 32 when the two are magnetically coupled together. One advantage to such spacing is that it facilitates separating the core 40 and the vane 32 after the electric current to the coil 54 is turned off. Even at zero current, if there is minimal spacing or no gap, the attractive force from residual magnetism would be relatively large and would make it difficult to separate the core 40 and the vane 32. Another advantage to the non-magnetic material layer 90 is that it facilitates accumulating any ferrous debris 82-86 around the interruption 80 such that none of it will tend to be attracted to the gap 50.

Figure 5:
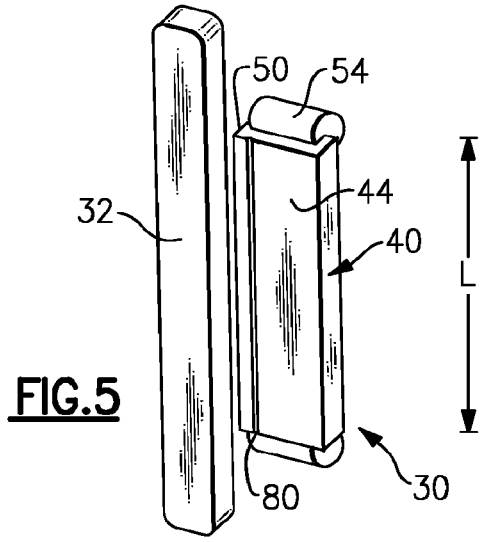
FIG. 5 shows another view of selected features of the example embodiment.

FIG. 5 shows an example where the interruption 80 extends along an entire longitudinal length L of the core 40. In this example, the interruption 80 comprises a groove on the exterior surface of the second side 44 of the example core 40. Such a groove may be established during a process of making or forming the core 40. One example includes machining in a groove or slot as the interruption 80 after the core 40 has been formed. Another example includes providing the interruption 80 as part of a molding or casting process. Another example includes providing corresponding portions of the interruption 80 in each of a plurality of laminations used for forming the core 40.

Figure 6:
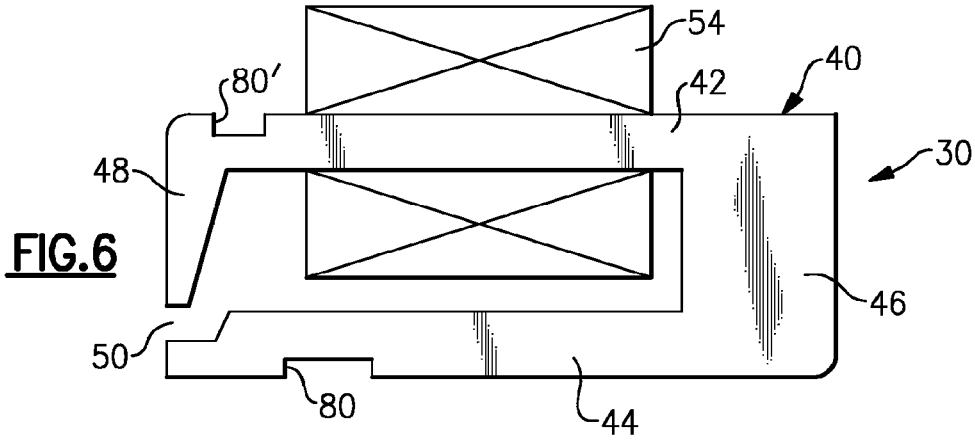
FIG. 6 shows another example embodiment.

FIG. 6 schematically shows another example embodiment where a second interruption 80' is provided on an opposite side of the active portion of the core 40. In this example, multiple interruptions 80, 80' facilitate collecting any ferrous debris that is otherwise in the vicinity of the gap 50 on a portion of the core 40 where the debris will not interfere with the desired operation of the coupling device.

Figure 7A:
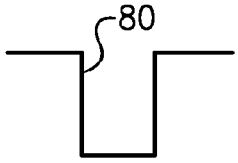
FIGS. 7A-7H show example configurations of a surface interruption useful in various embodiments.
Figure 7B:
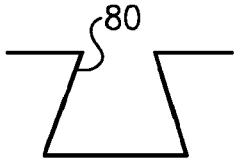
Figure 7C:
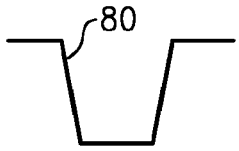
Figure 7D:
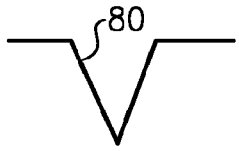
Figure 7E:
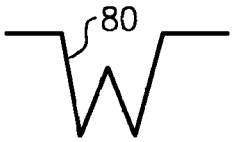
Figure 7F:
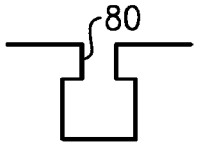
Figure 7G:
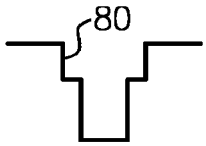
Figure 7H:
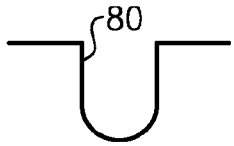

The interruption 80 can be configured to achieve a desired effect based upon other aspects of the design of a particular electromagnet 30. FIGS. 7A-7H schematically show a variety of possible interruption cross-sections or configurations. FIG. 7A shows a generally rectangular groove or interruption design. FIGS. 7B and 7C show generally trapezoidal configurations. FIGS. 7D and 7E include generally triangular arrangements. FIGS. 7F and 7G include stepped configurations. FIG. 7H includes an at least partially curvilinear profile within the interruption 80.

As can be appreciated from FIGS. 7B-7H, the width of such example interruptions is smaller at one location compared to another within the interruption. In the examples of FIGS. 7B-7D, for example, the width of the interruption continuously varies along a depth of the interruption. Given this description, those skilled in the art will be able to select a configuration that best meets their particular needs.

The illustrated examples provide a variety of advantages when incorporated as a portion of an elevator door coupling arrangement. The aspect ratio of the core 40 (e.g., the length L relative to a thickness taken in a perpendicular direction) is high, which allows for generating a sufficiently strong magnetically attractive force to reliably couple an elevator car door and a hoistway door while still fitting the coupler arrangement within the tight space constraints of an elevator system. The example interruptions 80 facilitate avoiding collection of debris along a portion of the electromagnet 30 where such debris could potentially interfere with the operation of a door coupler arrangement. Preventing an accumulation of any ferrous debris at the interface between the electromagnetic 30 and the vane 32 is accomplished without any additional cost and without deteriorating the attraction forces used for the coupling. Additionally, the debris control aspects of the illustrated examples do not raise or complicate the power consumption associated with the electromagnet 30. There are no additional pieces required for achieving the debris controlling features.

The example interruptions 80 increase the reliability of the electromagnet 30 and the door interlock system. This tends to provide improved elevator system performance because it minimizes the likelihood of a malfunction or maintenance request. Additionally, reliably coupling an elevator car door and a hoistway door tends to improve the reliability of door operation, which enhances passenger access to the elevator car.

Another feature of the example non-magnetic material layer 90 is that it permits some relative movement between the electromagnet 30 and the vane 32 even when a magnetic coupling is established between them. The non-magnetic material layer 90 in one example serves as a sliding layer that accommodates some relative movement in a vertical direction, a horizontal direction or both. Such movement may be associated with loading and unloading the elevator car at a landing, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

What is claimed is:

1. A magnetic coupling device, comprising:

a core having an exterior surface;

an active portion of the core being configured to direct a magnetic flux associated with the core in a desired direction; and an interruption in the exterior surface near the active portion, the interruption is configured to establish a relatively high magnetic saturation in the core in a vicinity of the interruption.

2. The device of claim 1, wherein the interruption comprises a groove in the core.

3. The device of claim 2, wherein the core has a longitudinal length and the groove extends along the exterior surface along the entire longitudinal length.

4. The device of claim 2, wherein the groove has a generally rectangular cross-section.

5. The device of claim 2, wherein the groove has a width having a first dimension at a first location in the groove and a second, different dimension at a second location in the groove.

6. The device of claim 5, wherein the groove has a depth and the width varies along the depth.

7. The device of claim 1, wherein the interruption is configured to establish a reduced cross-section of the core in the vicinity of the interruption.

8. The device of claim 7, wherein the interruption has a depth, an uninterrupted portion of the core has a thickness and the reduced cross-section is approximately equal to a difference between the thickness and the depth.

9. The device of claim 7, wherein the reduced cross-section is configured to increase a reluctance for a magnetic flux along the reduced cross-section of the core.

10. The device of claim 1, comprising a second interruption.

11. The device of claim 10, wherein the interruptions are on opposite sides of the active portion.

12. The device of claim 1, wherein the active portion comprises a gap in the core, the gap has a dimension and a distance between the gap and the interruption is greater than the gap dimension.

13. The device of claim 12, wherein the distance is between about two times and about five times the gap dimension.

14. The device of claim 1, wherein the core comprises a plurality of laminations, each having a portion of the interruption.

15. The device of claim 1, wherein the core comprises at least one of carbon, silicon or steel.

16. The device of claim 1, comprising a non-magnetic material layer associated with the active portion.

17. The device of claim 1, comprising an electrically conductive coil wrapped around part of the core and covering some of the exterior surface such that the active portion and the interruption are not covered by the coil.

18. The device of claim 1, comprising a ferromagnetic vane member selectively magnetically coupled with the core.

19. The device of claim 18, wherein the ferromagnetic vane member is positioned to face the active portion of the core.

20. The device of claim 19, comprising an elevator car door;

a hoistway door; and wherein the core is supported on one of the elevator car door or the hoistway door and the ferromagnetic vane member is supported on the other of the hoistway door or the elevator car door and a magnetic coupling between the core and the ferromagnetic vane member facilitates coupling the elevator car door and the hoistway door for moving the hoistway door and the elevator car door together.

* * * * *